US008978783B2

(12) United States Patent
Cruickshank et al.

(10) Patent No.: US 8,978,783 B2
(45) Date of Patent: Mar. 17, 2015

(54) JET ARRANGEMENT ON AN EXPANDABLE DOWNHOLE TOOL

(75) Inventors: Brian Cruickshank, The Woodlands, TX (US); Manoj Mahajan, Houston, TX (US); Navish Makkar, Spring, TX (US); Sameer Bhoite, Conroe, TX (US); Charles Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 365 days.

(21) Appl. No.: 13/116,777

(22) Filed: May 26, 2011

(65) Prior Publication Data

US 2012/0298423 A1 Nov. 29, 2012

(51) Int. Cl.

| | |
|---|---|
| ***E21B 7/00*** | (2006.01) |
| ***E21B 10/32*** | (2006.01) |
| ***E21B 10/60*** | (2006.01) |
| ***E21B 17/10*** | (2006.01) |

(52) U.S. Cl.

CPC ..... *E21B 10/322* (2013.01); *E21B 10/60* (2013.01); *E21B 17/1078* (2013.01)

USPC ..... 175/57; 175/385; 175/273; 175/269

(58) Field of Classification Search

USPC ..... 175/273; 166/55.8

See application file for complete search history.

(56) References Cited

U.S. PATENT DOCUMENTS

| | | | | |
|---|---|---|---|---|
| 3,224,507 | A | 12/1965 | Cordary et al. | |
| 3,425,500 | A | 2/1969 | Fuchs | |
| 4,055,226 | A | 10/1977 | Weber | |
| 4,848,490 | A | 7/1989 | Anderson | |
| 5,318,137 | A | 6/1994 | Johnson et al. | |
| 5,318,138 | A | 6/1994 | Dewey et al. | |
| 5,332,048 | A | 7/1994 | Underwood et al. | |
| 6,039,131 | A | 3/2000 | Beaton | |
| 6,269,893 | B1 | 8/2001 | Beaton et al. | |
| 6,709,675 | B1 | 3/2004 | Lombardin et al. | |
| 6,732,817 | B2 * | 5/2004 | Dewey et al. | 175/57 |
| 7,703,553 | B2 | 4/2010 | Eddison et al. | |
| 2008/0128174 | A1 * | 6/2008 | Radford et al. | 175/267 |

FOREIGN PATENT DOCUMENTS

| | | |
|---|---|---|
| RU | 2341639 | 12/2008 |
| SU | 941529 | 7/1983 |
| WO | 0031371 | 1/2000 |

OTHER PUBLICATIONS

International Search Report and Written Opinion of PCT Application No. PCT/US2012/039410 dated May 24, 2012: pp. 1-8.

* cited by examiner

*Primary Examiner* — Jennifer H Gay
*Assistant Examiner* — Caroline Butcher
(74) *Attorney, Agent, or Firm* — Osha Liang LLP

(57) ABSTRACT

The expandable tools disclosed herein may be used as an underreamer to enlarge a borehole, or may be used to stabilize a drilling system in a previously underreamed borehole or in a borehole that is being underreamed while drilling progresses. At least one moveable arm, which translates between a collapsed and expanded position in response to a differential pressure between the axial flowbore and the wellbore, includes a borehole-engaging surface with cutting elements and at least one nozzle to direct a fluid across the borehole-engaging surface. Flow directing elements on the external surface of the tool may be used to decrease the flow area in an annulus between the tool and the wellbore and directs fluid flow in the annulus toward the borehole-engaging surface.

24 Claims, 9 Drawing Sheets

JET ARRANGEMENT ON AN EXPANDABLE DOWNHOLE TOOL

FIELD OF THE DISCLOSURE

Embodiments disclosed herein relate generally to underreamers used for enlarging a borehole below a restriction to result in a borehole that is larger than the restriction. Embodiments disclosed herein also relate generally to stabilizers used for controlling the trajectory of a drill bit during the drilling process. More particularly, embodiments disclosed herein relate to delivering drilling fluid having an increased hydraulic energy to remove drill cuttings proximate cutting structures on an expandable tool that may function as an underreamer, or alternatively, may function as a stabilizer in an underreamed portion of borehole.

BACKGROUND

In the drilling of oil and gas wells, concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through an existing cased borehole and enlarging the borehole below the casing. One such method is the use of an underreamer, which has basically two operative states—a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is typically used in conjunction with a conventional pilot drill bit positioned below or downstream of the underreamer. The pilot bit can drill the borehole at the same time as the underreamer enlarges the borehole formed by the bit. Underreamers of this type usually have hinged arms with roller cone cutters attached thereto. Most of the prior art underreamers utilize swing out cutter arms that are pivoted at an end opposite the cutting end of the cutting arms, and the cutter arms are actuated by mechanical or hydraulic forces acting on the arms to extend or retract them. Typical examples of these types of underreamers are found in U.S. Pat. Nos. 3,224,507; 3,425,500 and 4,055,226. In some designs, these pivoted arms tend to break during the drilling operation and must be removed or "fished" out of the borehole before the drilling operation can continue. The traditional underreamer tool typically has rotary cutter pocket recesses formed in the body for storing the retracted arms and roller cone cutters when the tool is in a closed state. The pocket recesses form large cavities in the underreamer body, which requires the removal of the structural metal forming the body, thereby compromising the strength and the hydraulic capacity of the underreamer. Accordingly, these prior art underreamers may not be capable of underreaming harder rock formations, or may have unacceptably slow rates of penetration, and they are not optimized for the high fluid flow rates required. The pocket recesses also tend to fill with debris from the drilling operation, which hinders collapsing of the arms. If the arms do not fully collapse, the drill string may easily hang up in the borehole when an attempt is made to remove the string from the borehole.

Conventional underreamers have several disadvantages, including cutting structures that are typically formed of sections of drill bits rather than being specifically designed for the underreaming function. Therefore, the cutting structures of most underreamers do not reliably underream the borehole to the desired diameter. A further disadvantage is that adjusting the expanded diameter of a conventional underreamer requires replacement of the cutting arms with larger or smaller arms, or replacement of other components of the underreamer tool. It may even be necessary to replace the underreamer altogether with one that provides a different expanded diameter. Another disadvantage is that many underreamers are designed to automatically expand when drilling fluid is pumped through the drill string, and no indication is provided at the surface that the underreamer is in the fully-expanded position. In some applications, it may be desirable for the operator to control when the underreamer expands.

Accordingly, it would be advantageous to provide an underreamer that is stronger than prior art underreamers, with a hydraulic capacity that is optimized for the high flowrate drilling environment. It would further be advantageous for such an underreamer to include several design features, namely cutting structures designed for the underreaming function, mechanisms for adjustment of the expanded diameter without requiring component changes, and the ability to provide indication at the surface when the underreamer is in the fully-expanded position. Moreover, in the presence of hydraulic pressure in the drill string, it would be advantageous to provide an underreamer that is selectively expandable.

Another method for enlarging a borehole below a previously cased borehole section includes using a winged reamer behind a conventional drill bit. In such an assembly, a conventional pilot drill bit is disposed at the lowermost end of the drilling assembly with a winged reamer disposed at some distance behind the drill bit. The winged reamer generally comprises a tubular body with one or more longitudinally extending "wings" or blades projecting radially outwardly from the tubular body. Once the winged reamer has passed through any cased portions of the wellbore, the pilot bit rotates about the centerline of the drilling axis to drill a lower borehole on center in the desired trajectory of the well path, while the eccentric winged reamer follows the pilot bit and engages the formation to enlarge the pilot borehole to the desired diameter.

Yet another method for enlarging a borehole below a previously cased borehole section includes using a bi-center bit, which is a one-piece drilling structure that provides a combination underreamer and pilot bit. The pilot bit is disposed on the lowermost end of the drilling assembly, and the eccentric underreamer bit is disposed slightly above the pilot bit. Once the bi-center bit has passed through any cased portions of the wellbore, the pilot bit rotates about the centerline of the drilling axis and drills a pilot borehole on center in the desired trajectory of the well path, while the eccentric underreamer bit follows the pilot bit and engages the formation to enlarge the pilot borehole to the desired diameter. The diameter of the pilot bit is made as large as possible for stability while still being capable of passing through the cased borehole. Examples of bi-center bits may be found in U.S. Pat. Nos. 6,039,131 and 6,269,893.

As described above, winged reamers and bi-center bits each include underreamer portions that are eccentric. A number of disadvantages are associated with this design. First, before drilling can continue, cement and float equipment at the bottom of the lowermost casing string must be drilled out. However, the pass-through diameter of the drilling assembly at the eccentric underreamer portion barely fits within the lowermost casing string. Therefore, off-center drilling is required to drill out the cement and float equipment to ensure that the eccentric underreamer portions do not damage the casing. Accordingly, it is desirable to provide an underreamer that collapses while the drilling assembly is in the casing and that expands to underream the previously drilled borehole to the desired diameter below the casing.

Further, due to directional tendency problems, these eccentric underreamer portions have difficulty reliably underreaming the borehole to the desired diameter. With respect to a bi-center bit, the eccentric underreamer bit tends to cause the pilot bit to wobble and undesirably deviate off center, thereby pushing the pilot bit away from the preferred trajectory of drilling the well path. A similar problem is experienced with respect to winged reamers, which only underream the borehole to the desired diameter if the pilot bit remains centralized in the borehole during drilling. Accordingly, it is desirable to provide an underreamer that remains concentrically disposed in the borehole while underreaming the previously drilled borehole to the desired diameter.

In drilling operations, it is conventional to employ a tool known as a "stabilizer." In standard boreholes, traditional stabilizers are located in the drilling assembly behind the drill bit for controlling the trajectory of the drill bit as drilling progresses. Traditional stabilizers control drilling in a desired direction, whether the direction is along a straight borehole or a deviated borehole.

In a conventional rotary drilling assembly, a drill bit may be mounted onto a lower stabilizer, which is disposed approximately 5 feet above the bit. Typically the lower stabilizer is a fixed blade stabilizer that includes a plurality of concentric blades extending radially outwardly and spaced azimuthally around the circumference of the stabilizer housing. The outer edges of the blades are adapted to contact the wall of the existing cased borehole, thereby defining the maximum stabilizer diameter that will pass through the casing. A plurality of drill collars extends between the lower stabilizer and other stabilizers in the drilling assembly. An upper stabilizer is typically positioned in the drill string approximately 30-60 feet above the lower stabilizer. There could also be additional stabilizers above the upper stabilizer. The upper stabilizer may be either a fixed blade stabilizer or, more recently, an adjustable blade stabilizer that allows the blades to be collapsed into the housing as the drilling assembly passes through the casing and then expanded in the borehole below. One type of adjustable concentric stabilizer is manufactured by Andergauge U.S.A., Inc., Spring, Tex. and is described in U.S. Pat. No. 4,848,490. Another type of adjustable concentric stabilizer is manufactured by Halliburton, Houston, Tex. and is described in U.S. Pat. Nos. 5,318,137; 5,318,138; and 5,332,048.

In operation, if only the lower stabilizer was provided, a "fulcrum" type assembly would be present because the lower stabilizer acts as a fulcrum or pivot point for the bit. Namely, as drilling progresses in a deviated borehole, for example, the weight of the drill collars behind the lower stabilizer forces the stabilizer to push against the lower side of the borehole, thereby creating a fulcrum or pivot point for the drill bit. Accordingly, the drill bit tends to be lifted upwardly at an angle, i.e., build angle. Therefore, a second stabilizer is provided to offset the fulcrum effect. Namely, as the drill bit builds angle due to the fulcrum effect created by the lower stabilizer, the upper stabilizer engages the lower side of the borehole, thereby causing the longitudinal axis of the bit to pivot downwardly so as to drop angle. A radial change of the blades of the upper stabilizer can control the pivoting of the bit on the lower stabilizer, thereby providing a two-dimensional, gravity based steerable system to control the build or drop angle of the drilled borehole as desired.

When an underreamer or a winged reamer tool is operating behind a conventional bit to underream the borehole, that tool provides the same fulcrum effect to the bit as the lower stabilizer in a standard borehole. Similarly, when underreaming a borehole with a bi-center bit, the eccentric underreamer bit provides the same fulcrum effect as the lower stabilizer in a standard borehole. Accordingly, in a drilling assembly employing an underreamer, winged reamer, or a bi-center bit, a lower stabilizer is not typically provided. However, to offset the fulcrum effect imparted by to the drill bit, it would be advantageous to provide an upper stabilizer capable of controlling the inclination of the drilling assembly in the underreamed section of borehole.

In particular, it would be advantageous to provide an upper stabilizer that engages the wall of the underreamed borehole to keep the centerline of the pilot bit centered within the borehole. When utilized with an eccentric underreamer that tends to force the pilot bit off center, the stabilizer blades would preferably engage the opposite side of the expanded borehole to counter that force and keep the pilot bit on center.

When an underreamer and/or a stabilizer are operated in a drilling environment and under various drilling conditions, cutting elements may suffer thermal degradation due to frictional abrasive contact with the formation. Additionally, if cuttings generated are not removed at a fast enough rate, an increase in frictional contact on the cutting elements may result, leading to damage or premature failure in the form of heat cracks or carbide wear. It is thus of great importance to have a system that can remove the cuttings at a fast rate and provide sufficient cooling of the cutting elements.

SUMMARY OF THE CLAIMED EMBODIMENTS

In one aspect, embodiments disclosed herein relate to an expandable downhole tool for use in a drilling assembly positioned within a wellbore. The expandable downhole tool may include: a tubular body including at least one axial recess, a plurality of channels formed into a wall of said at least one axial recess, and an axial flowbore extending therethrough; at least one moveable arm, wherein the at least one moveable arm translates along said plurality of channels between a collapsed position and an expanded position in response to a differential pressure between the axial flowbore and the wellbore; the at least one moveable arm further comprising a borehole-engaging surface; and at least one flow directing element that: decreases a flow area in an annulus formed between the expandable downhole tool and the wellbore; and directs a flow of fluid in the annulus toward the borehole-engaging surface.

In another aspect, embodiments disclosed herein relate to an expandable downhole tool for use in a drilling assembly positioned within a wellbore, including: a tubular body including at least one axial recess, a plurality of channels formed into a wall of said at least one axial recess, and an axial flowbore extending therethrough; at least one moveable arm, wherein the at least one moveable arm translates along said plurality of channels between a collapsed position and an expanded position in response to a differential pressure between the axial flowbore and the wellbore; the at least one moveable arm further comprising a borehole-engaging surface and at least one nozzle to direct a fluid across the borehole-engaging surface of the at least one moveable arm.

In another aspect, embodiments disclosed herein relate to an expandable downhole tool for use in a drilling assembly positioned within a wellbore, including: a tubular body including at least one axial recess, a plurality of channels formed into a wall of said at least one axial recess, and an axial flowbore extending therethrough; at least one moveable arm, wherein the at least one moveable arm translates along said plurality of channels between a collapsed position and an expanded position in response to a differential pressure between the axial flowbore and the wellbore; at least one nozzle to direct a fluid across a borehole-engaging surface of the at least one moveable arm; the tubular body further including at least one fluid flow path for transporting the fluid from the axial flowbore to the at least one nozzle.

In another aspect, embodiments disclosed herein relate to a drilling assembly for underreaming a wellbore to form an enlarged borehole, including: a drill bit to drill the wellbore; and at least one expandable tool as described in the preceding paragraphs.

In another aspect, embodiments disclosed herein relate to a method of drilling a wellbore, including: using a drill bit to drill the wellbore; disposing at least one expandable tool as described in the preceding paragraphs above the drill bit; using the at least one expandable tool to form an enlarged borehole or to control directional tendencies of said drilling assembly.

Other aspects and advantages will be apparent from the following description and the appended claims.

DETAILED DESCRIPTION

In one aspect, embodiments herein relate to methods and apparatus for underreaming to enlarge a borehole below a restriction, such as casing. Alternatively, the embodiments herein relate to methods and apparatus for stabilizing a drilling assembly and thereby controlling the directional tendencies of the drilling assembly within an enlarged borehole. In more particular aspects, embodiments disclosed herein relate to delivering drilling fluid having an increased hydraulic energy to remove drill cuttings proximate cutting structures on expandable tools useful for underreaming and stabilizing the drilling assembly.

In particular, various embodiments disclosed herein provide a number of different constructions and methods of operation. Each of the various embodiments may be used to enlarge a borehole, or to provide stabilization in a previously enlarged borehole, or in a borehole that is simultaneously being enlarged. The preferred embodiments of the expandable tools disclosed herein may be utilized as an underreamer, or as a stabilizer behind a bi-center bit, or as a stabilizer behind a winged reamer or underreamer following a conventional bit. The embodiments disclosed herein also provide a plurality of methods for use in a drilling assembly. It is to be fully recognized that the different teachings of the embodiments disclosed herein may be employed separately or in any suitable combination to produce desired results.

It should be appreciated that the expandable tools described with respect to the Figures that follow may be used in many different drilling assemblies. The following exemplary systems provide only some of the representative assemblies within which the expandable tools described herein may be used, but these should not be considered the only assemblies. In particular, the preferred embodiments of the expandable tool disclosed herein may be used in any assembly requiring an expandable underreamer and/or stabilizer for use in controlling the directional tendencies of a drilling assembly in an expanded borehole.

Figure 3:
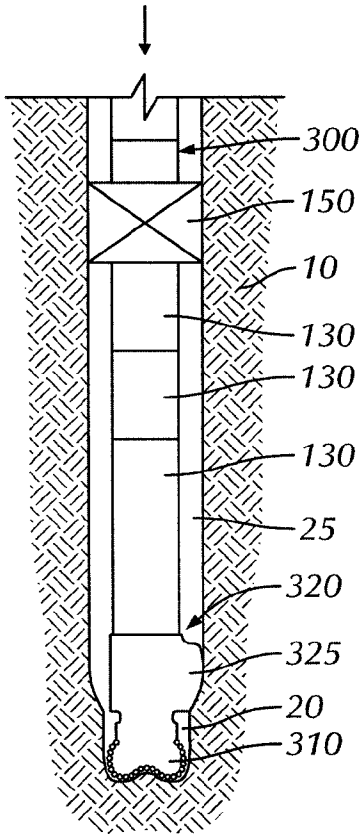
FIG. 3 is a schematic cross-sectional view of a drilling assembly that employs an expandable downhole tool according to embodiments disclosed herein.
Figure 2:
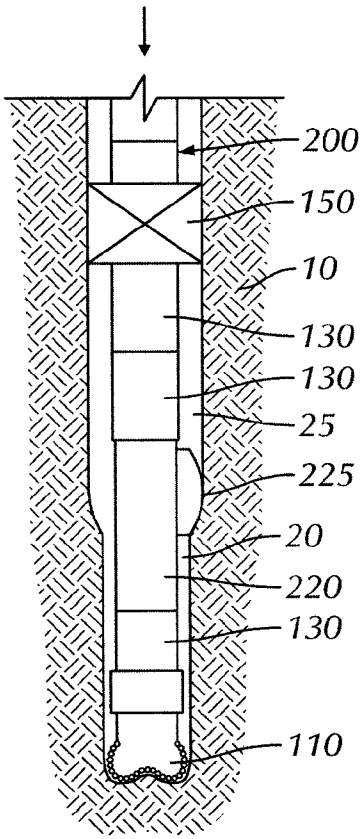
FIG. 2 is a schematic cross-sectional view of a drilling assembly that employs an expandable downhole tool according to embodiments disclosed herein.
Figure 1:
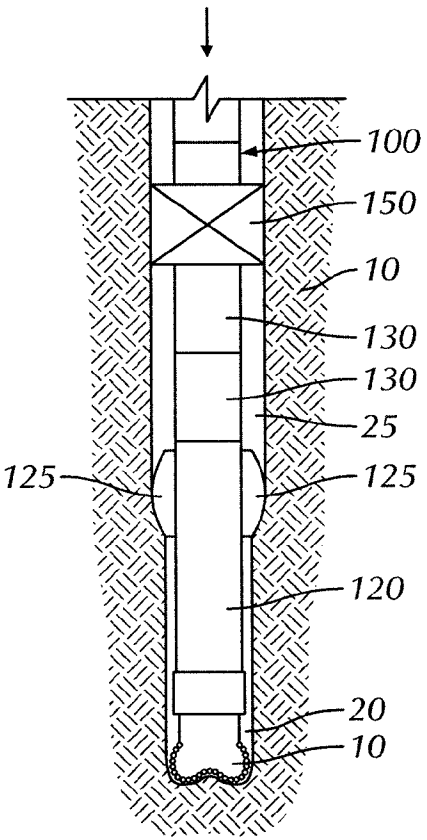
FIG. 1 is a schematic cross-sectional view of a drilling assembly that employs an expandable downhole tool according to embodiments disclosed herein.

FIGS. 1-3 show various exemplary drilling assemblies within which embodiments of the expandable downhole tools disclosed herein may be utilized. Referring initially to FIG. 1, a section of a drilling assembly generally designated as 100 is shown drilling into the bottom of a formation 10 with a conventional drill bit 110 followed by an underreamer 120. Separated from the underreamer 120 by one or more drill collars 130 is a stabilizer 150 that controls the directional tendencies of the drilling assembly 100 in the underreamed borehole 25. This section of the drilling assembly 100 is shown at the bottom of formation 10 drilling a borehole 20 with the conventional drill bit 110, while the underreamer cutting arms 125 are simultaneously opening a larger diameter borehole 25 above. The drilling assembly 100 is operating below any cased portions of the well.

As described previously, the underreamer 120 tends to provide a fulcrum or pivot effect to the drill bit 110, thereby requiring a stabilizer 150 to offset this effect. In the drilling assembly 100, the expandable tools according to embodiments disclosed herein are provided in the positions of both the underreamer 120 and the stabilizer 150. In the most preferred embodiments, the stabilizer 150 would also preferably include cutting structures to ensure that the larger borehole 25 is enlarged to the proper diameter. However, any conventional underreamer may alternatively be utilized with embodiments disclosed herein provided in the position of stabilizer 150 in the drilling assembly 100. Further, embodiments may be utilized in the position of underreamer 120, and a conventional stabilizer may be utilized in the position of stabilizer 150.

Referring now to FIG. 2, where like numerals represent like components, a drilling assembly 200 is shown disposed within formation 10, below any cased sections of the well. The drilling assembly 200 is drilling a borehole 20 utilizing a conventional drill bit 110 followed by a winged reamer 220. The winged reamer 220 may be separated from the drill bit 110 by one or more drill collars 130, but preferably the winged reamer 220 is connected directly above the drill bit 110. Upstream of the winged reamer 220, separated by one or more drill collars 130, is a stabilizer 150 that controls the directional tendencies of the drilling assembly 200 in the underreamed borehole 25. The drill bit 110 is shown at the bottom of the formation 10 drilling a borehole 20, while the wing component 225 of the winged reamer 220 is simultaneously opening a larger diameter borehole 25 above. In the preferred assembly 200, a preferred embodiment of expandable tool would be located in the position of stabilizer 150. In a most preferred assembly 200, the stabilizer 150 would also include cutting structures to ensure that the larger borehole 25 is enlarged to the proper diameter.

Referring to FIG. 3, where like numerals represent like components, again a drilling assembly 300 is shown disposed within formation 10, below any cased sections of the well. The drilling assembly 300 utilizes a bi-center bit 320 that includes a pilot bit 310 and an eccentric underreamer bit 325. As the pilot bit 310 drills the borehole 20, the eccentric underreamer bit 325 opens a larger diameter borehole 25 above. The bi-center bit 320 is separated by one or more drill collars 130 from a stabilizer 150 designed to control the directional tendencies of the bi-center bit 320 in the underreamed borehole 25. Again, the function of the stabilizer 150 is to offset the fulcrum or pivot effect created by the eccentric underreamer bit 325 to ensure that the pilot bit 310 stays centered as it drills the borehole 20. In the preferred embodiment of the drilling assembly 300, one embodiment of the expandable tool disclosed herein would be located in the position of stabilizer 150. In a most preferred assembly 300, the stabilizer 150 would also include cutting structures to ensure that the larger borehole 25 is enlarged to the proper diameter.

Figure 4:
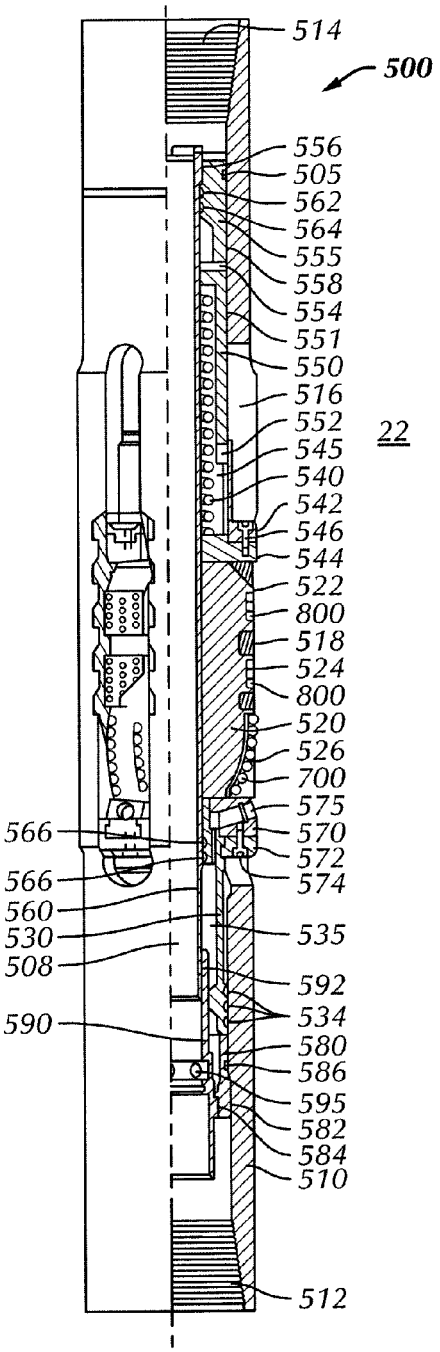
FIG. 4 is a cross-sectional elevation view of a prior art expandable tool, showing the movable arms in the collapsed position.
Figure 5:
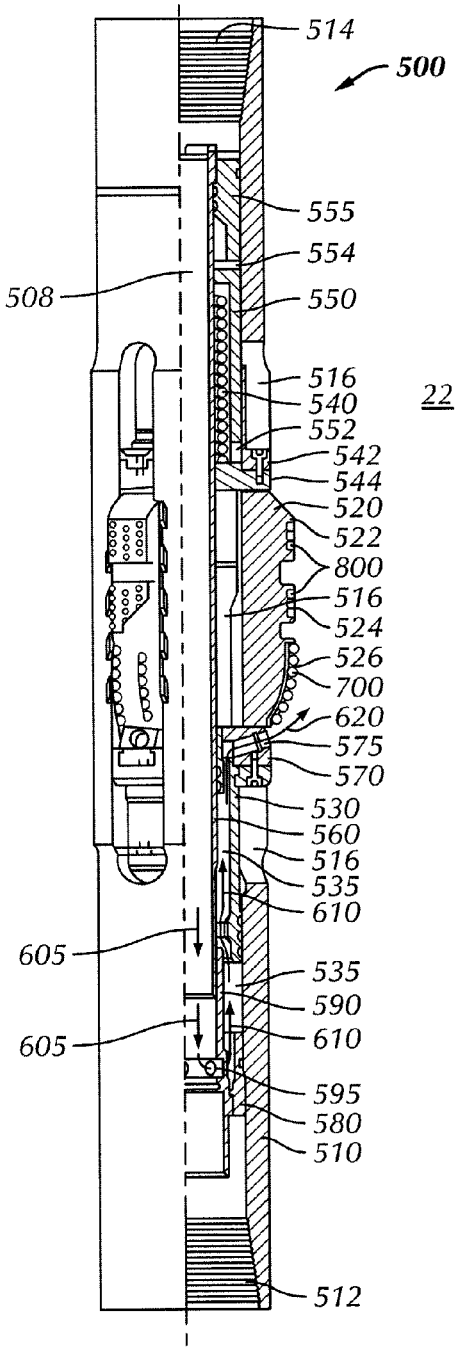
FIG. 5 is a cross-sectional elevation view of a prior art expandable tool, showing the movable arms in the expanded position.

Referring now to FIGS. 4 and 5, an expandable tool as disclosed in U.S. Pat. No. 6,732,817 is reproduced, generally designated as 500, and is shown in a collapsed position in FIG. 4 and in an expanded position in FIG. 5. The expandable tool 500 comprises a generally cylindrical tool body 510 with a flowbore 508 extending therethrough. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more moveable, non-pivotable tool arms 520. Each recess 516 stores one moveable arm 520 in the collapsed position.

The recesses 516 further include angled channels 518 that provide a drive mechanism for the moveable tool arms 520 to move axially upwardly and radially outwardly into the expanded position of FIG. 5. A biasing spring 540 is preferably included to bias the arms 520 to the collapsed position of FIG. 4. The biasing spring 540 is disposed within a spring cavity 545 and covered by a spring retainer 550. Retainer 550 is locked in position by an upper cap 555. A stop ring 544 is provided at the lower end of spring 540 to keep the spring 540 in position.

Below the moveable arms 520, a drive ring 570 is provided that includes one or more nozzles 575. An actuating piston 530 that forms a piston cavity 535, engages the drive ring 570. A drive ring block 572 connects the piston 530 to the drive ring 570 via bolt 574. The piston 530 is adapted to move axially in the pocket recesses 516. A lower cap 580 provides a lower stop for the axial movement of the piston 530. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

A threaded connection is provided at 556 between the upper cap 555 and the inner mandrel 560 and at 558 between the upper cap 555 and body 510. The upper cap 555 sealingly engages the body 510 at 505, and sealingly engages the inner mandrel 560 at 562 and 564. A wrench slot 554 is provided between the upper cap 555 and the spring retainer 550, which provides room for a wrench to be inserted to adjust the position of the spring retainer 550 in the body 510. Spring retainer 550 connects at 551 via threads to the body 510. Towards the lower end of the spring retainer 550, a bore 552 is provided through which a bar can be placed to prevent rotation of the spring retainer 550 during assembly. For safety purposes, a spring cover 542 is bolted at 546 to the stop ring 544. The spring cover 542 prevents personnel from incurring injury during assembly and testing of the tool 500.

The moveable arms 520 include pads 522, 524, and 526 with structures 700, 800 that engage the borehole when the arms 520 are expanded outwardly to the expanded position of the tool 500 shown in FIG. 5. Below the arms 520, the piston 530 sealingly engages the inner mandrel 560 at 566, and sealingly engages the body 510 at 534. The lower cap 580 is threadingly connected to the body and to the lower retainer 590 at 582, 584, respectively. A sealing engagement is also provided at 586 between the lower cap 580 and the body 510. The lower cap 580 provides a stop for the piston 530 to control the collapsed diameter of the tool 500.

Several components are provided for assembly rather than for functional purposes. For example, the drive ring 570 is coupled to the piston 530, and then the drive ring block 572 is boltingly connected at 574 to prevent the drive ring 570 and the piston 530 from translating axially relative to one another. The drive ring block 572, therefore, provides a locking connection between the drive ring 570 and the piston 530.

FIG. 5 depicts the tool 500 with the moveable arms 520 in the maximum expanded position, extending radially outwardly from the body 510. Once the tool 500 is in the borehole, it is only expandable to one position. Therefore, the tool 500 has two operational positions—namely a collapsed position as shown in FIG. 4 or an expanded position as shown in FIG. 5. However, the spring retainer 550, which is a threaded sleeve, can be adjusted at the surface to limit the full diameter expansion of arms 520. The spring retainer 550 compresses the biasing spring 540 when the tool 500 is collapsed, and the position of the spring retainer 550 determines the amount of expansion of the arms 520. The spring retainer 550 is adjusted by a wrench in the wrench slot 554 that rotates the spring retainer 550 axially downwardly or upwardly with respect to the body 510 at threads 551. The upper cap 555 is also a threaded component that locks the spring retainer 550 once it has been positioned.

In the expanded position shown in FIG. 5, the arms 520 will either underream the borehole or stabilize the drilling assembly, depending upon how the pads 522, 524 and 526 are configured. In the configuration of FIG. 5, cutting structures 700 on pads 526 would underream the borehole. Wear buttons 800 on pads 522 and 524 would provide gauge protection as the underreaming progresses. Hydraulic force causes the arms 520 to expand outwardly to the position shown in FIG. 5 due to the differential pressure of the drilling fluid between the flowbore 508 and the annulus 22.

The drilling fluid flows along path 605, through ports 595 in the lower retainer 590, along path 610 into the piston chamber 535. The differential pressure between the fluid in the flowbore 508 and the fluid in the borehole annulus 22 surrounding tool 500 causes the piston 530 to move axially upwardly from the position shown in FIG. 4 to the position shown in FIG. 5. A small amount of flow can move through the piston chamber 535 and through nozzles 575 to the annulus 22 as the tool 500 starts to expand. As the piston 530 moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are positioned to continuously provide cleaning and cooling to the cutting structures 700 disposed on surface 526 as fluid exits to the annulus 22 along flow path 620.

As described above in FIGS. 4 and 5, the expandable tool in U.S. Pat. No. 6,732,817 includes a fluid flow path from the flowbore 508 through ports 595 and piston cavity 535 to the nozzle 575, where the fluid flow path provides drilling fluid for removal of cuttings generated by the reamer cutting structures.

As one skilled in the art would recognize, in some drilling environments and under various drilling conditions, cutting elements may suffer thermal degradation due to frictional abrasive contact with the formation. Additionally, if cuttings generated are not removed at a fast enough rate, an increase in frictional contact on the cutting elements may result, leading to damage or premature failure in the form of heat cracks or carbide wear. It is thus of great importance to have a system that can remove the cuttings at a fast rate and provide sufficient cooling of the cutting elements.

It has surprisingly been found that a fluid flow path may be provided through the reamer body to increase the hydraulic energy at the reamer cutting structures. An increase in hydraulic energy at the cutting structures may advantageously improve the rate of removal of cuttings from the cutting structures (improved cuttings evacuation), may decrease cutter element wear, and may prevent damage or premature failure. Improved cuttings evacuation may also provide for improved cutting action and increased rates of reaming and cuttings removal, which may allow for an improvement in the overall rate of penetration.

Figure 6:
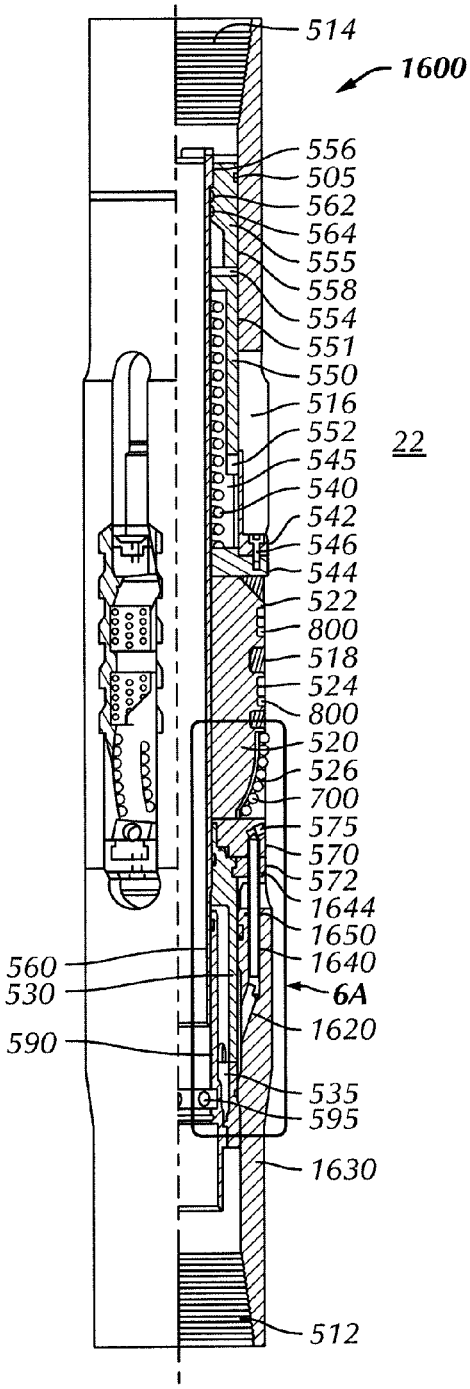
FIGS. 6 and 6A are cross-sectional elevation views of an expandable tool according to embodiments disclosed herein, showing the movable arms in the collapsed position.
Figure 6A:
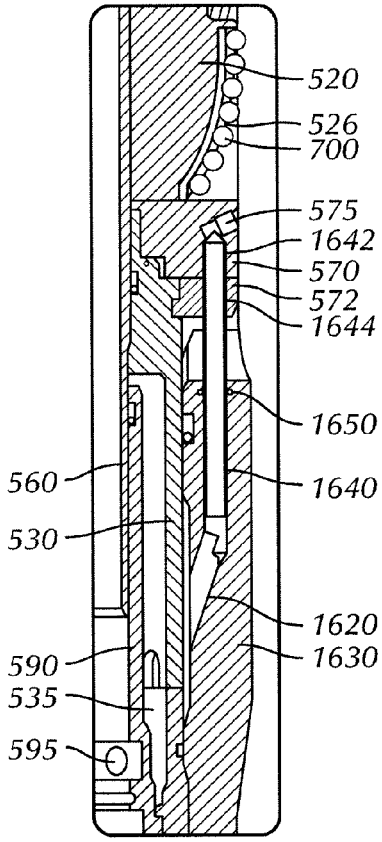
Figure 7:
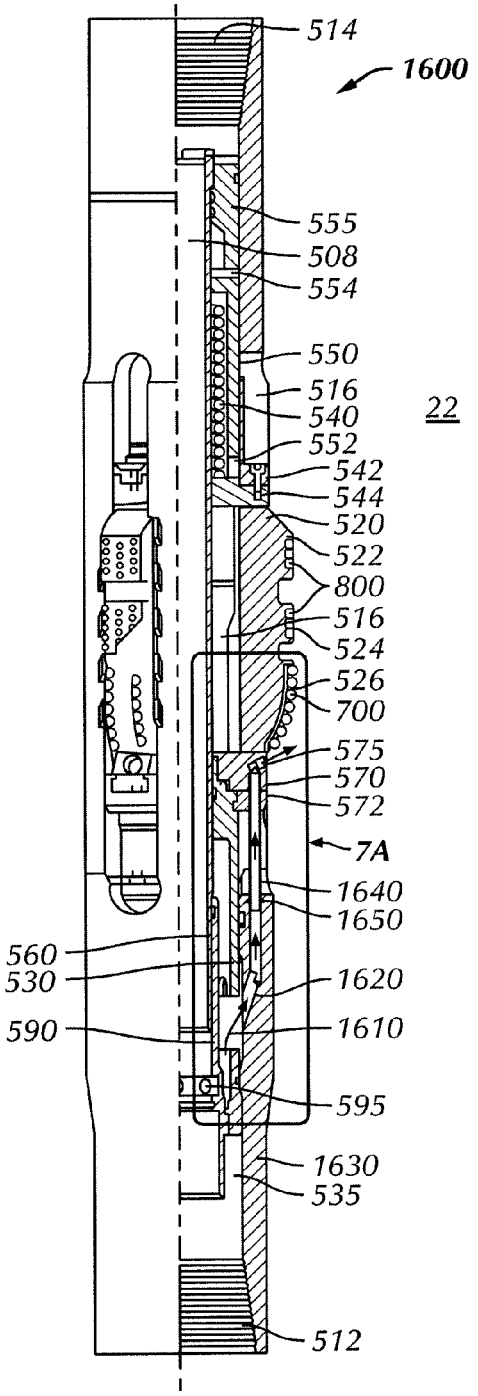
FIGS. 7 and 7A are cross-sectional elevation views of an expandable tool according to embodiments disclosed herein, showing the movable arms in the expanded position.
Figure 7A:
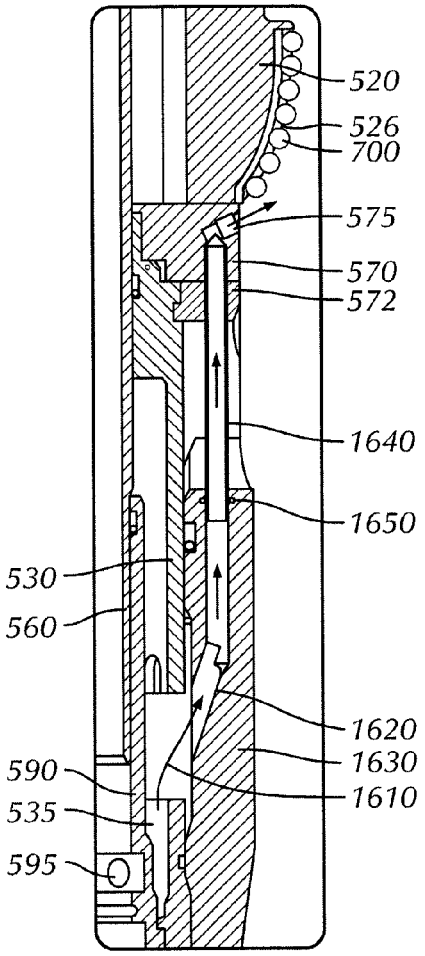

Referring now to FIGS. 6-7, one embodiment of an expandable tool 1600 according to embodiments disclosed herein is illustrated, shown in a collapsed position in FIG. 6 and in an expanded position in FIG. 7, where like numerals represent like parts. Lower retainer 590 includes ports 595 that allow drilling fluid to flow from the flowbore 508 into the piston chamber 535 to actuate the piston 530. The drilling fluid flows along path 605, through ports 595 in the lower retainer 590, along path 1610 into the piston chamber 535. The differential pressure between the fluid in the flowbore 508 and the fluid in the borehole annulus 22 surrounding tool 1600 causes the piston 530 to move axially upwardly from the position shown in FIG. 6 to the position shown in FIG. 7.

In the expanded position shown in FIG. 7, an amount of fluid can flow from the piston chamber 535 via a fluid flowbore 1620, provided through the cylindrical tool body 1630, and through nozzles 575 to the annulus 22 as the tool 1600 starts to expand. As the piston moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 (FIG. 6) disposed in the body 1630. In the expanded position, the fluid flow continues along paths 605, 1610 and out into the annulus 22 through nozzles 575.

In the embodiment illustrated in FIGS. 6 and 7, the nozzles 575 may be located in the drive ring 570. To provide for fluid communication between flowbore 1620 and nozzle 575, one end of a flow-carrying piston 1640 may be connected to drive ring 570 or drive ring retainer 572, with the other end movably disposed in the body 1630. A through-bore 1642, 1644 may be provided in drive ring 570 and drive ring retainer 572, as needed, to complete the flow path from flowbore 1620 through flow-carrying piston 1640 to nozzle 575.

As the piston 530 engages the drive ring 570, the drive ring 570 and/or drive ring retainer 572 move axially upwardly, thus also moving the flow-carrying piston 1640 axially upwardly within the flowbore 1620, effectively extending the flow channel for transporting fluid from the flowbore 1620 to the nozzle 575. If necessary, the flow-carrying piston 1640 may be appropriately sealed against the body 1630 using sealing elements 1650 to avoid any leakage of fluid from flowbore 1620 to the annulus 22 and bypassing flow-carrying piston 1640 and nozzle 575.

Through use of a flowbore provided in the cylindrical tool body itself, drilling fluid may thus be emitted through the nozzles at a higher velocity and impinged on the cutting elements at a higher hydraulic energy as compared to use of the flow path as described with respect to FIGS. 4 and 5.

Figure 8:
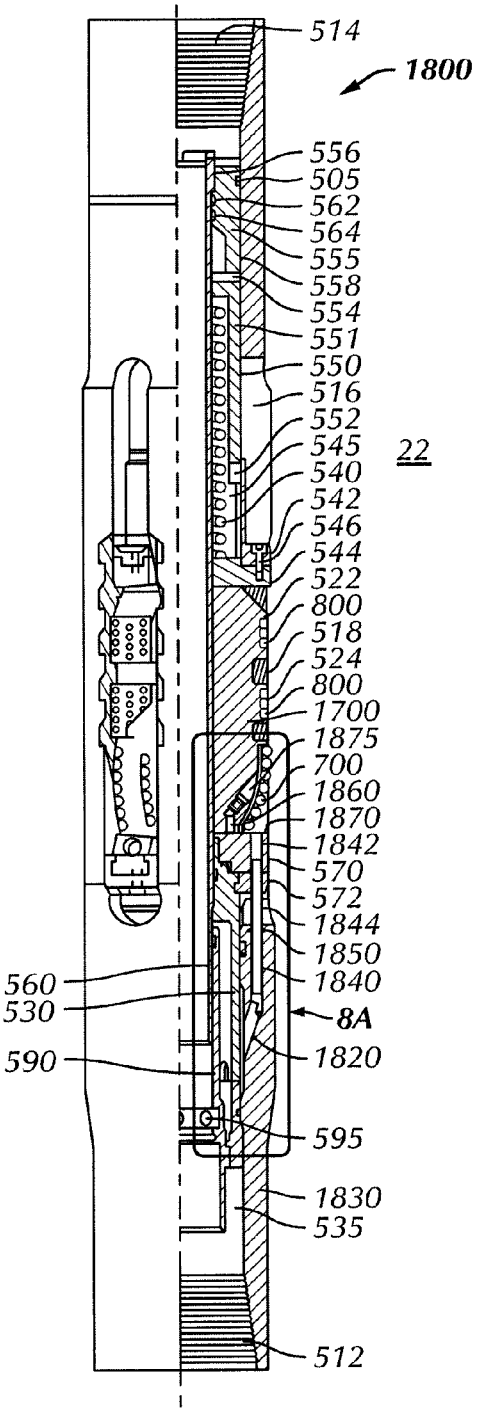
FIGS. 8 and 8A are cross-sectional elevation views of an expandable tool according to embodiments disclosed herein, showing the movable arms in the collapsed position.
Figure 8A:
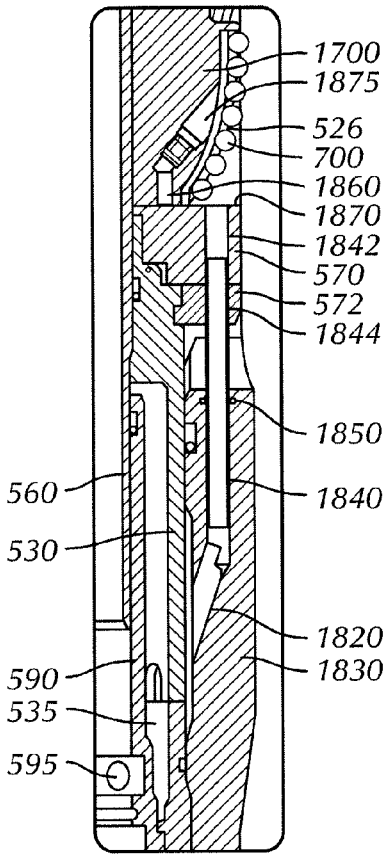
Figure 9:
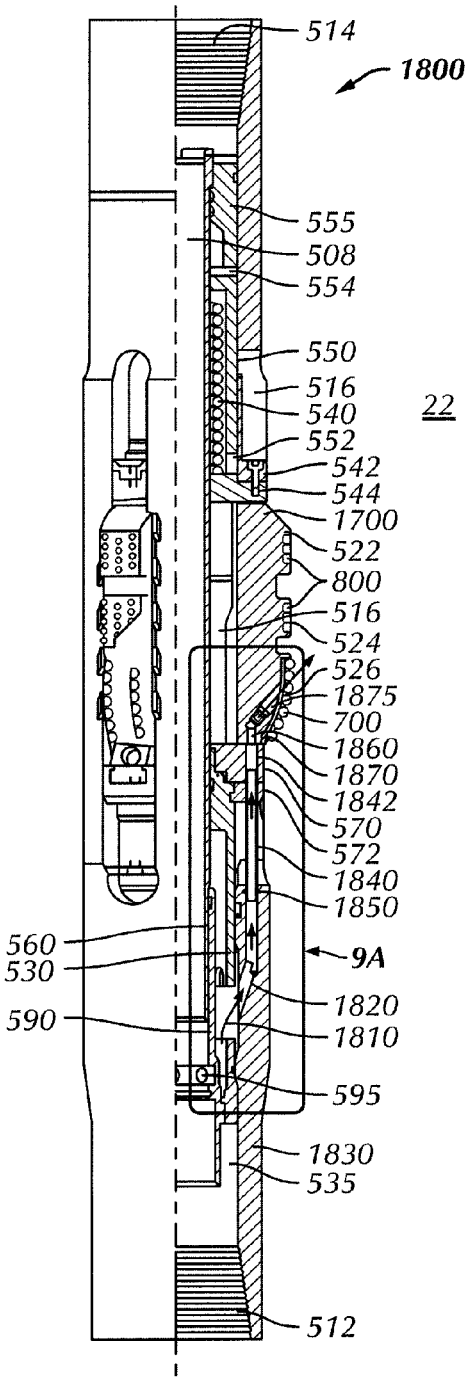
FIGS. 9 and 9A are cross-sectional elevation views of an expandable tool according to embodiments disclosed herein, showing the movable arms in the expanded position.
Figure 9A:
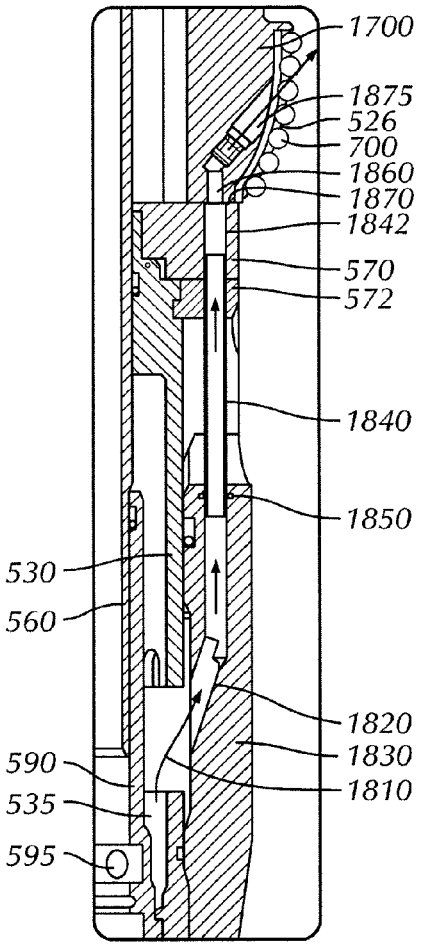

Referring now to FIGS. 8-9, another embodiment of an expandable tool 1800 according to embodiments disclosed herein is illustrated, shown in a collapsed position in FIG. 8 and in an expanded position in FIG. 9, where like numerals represent like parts. Lower retainer 590 includes ports 595 that allow drilling fluid to flow from the flowbore 508 into the piston chamber 535 to actuate the piston 530. The drilling fluid flows along path 605, through ports 595 in the lower retainer 590, along path 1810 into the piston chamber 535. The differential pressure between the fluid in the flowbore 508 and the fluid in the borehole annulus 22 surrounding tool 1800 causes the piston 530 to move axially upwardly from the position shown in FIG. 8 to the position shown in FIG. 9.

In the expanded position shown in FIG. 9, an amount of fluid can flow from the piston chamber 535 via a fluid flowbore 1820, provided through the cylindrical tool body 1830 as the tool 1800 starts to expand. As the piston moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 1630. In the expanded position, the fluid flow continues along paths 605, 1810 and out into the annulus 22 through nozzles 1875.

In the embodiment illustrated in FIGS. 8 and 9, the nozzles 1875 may be located proximate the cutting structures 700 in moveable arms 1700. To provide for fluid communication between flowbore 1820 and nozzle 1875, one end of a flow-carrying piston 1840 may be connected to drive ring 570 or drive ring retainer 572, with the other end movably disposed in the body 1830. A through-bore 1842, 1844 may be provided in drive ring 570 and drive ring retainer 572, as needed, to complete the flow path from flowbore 1820 through flow-carrying piston 1840 to an upper end of drive ring 570. A fluid flow path 1860 is also provided through the interior of moveable arm 1700 to nozzles 1875. In the collapsed position, as illustrated in FIG. 8, the flow path in the drive ring 570 (such as bore 1842 or upper end of piston 1840) will not be aligned with the flow path 1860 in moveable arm 1700.

As the piston 530 engages the drive ring 570, the drive ring 570 and/or drive ring retainer 572 move axially upwardly, thus also moving the flow-carrying piston 1840 axially upwardly within the flowbore 1820, effectively extending the flow channel for transporting fluid through flowbore 1820. If necessary, the flow-carrying piston 1840 may be appropriately sealed against the body 1830 using sealing elements 1850 to avoid any leakage of fluid from flowbore 1820 to the annulus 22 and bypassing flow-carrying piston 1840 and nozzle 1875. A face seal 1870 may also be provided on the drive ring 570 to prevent leakage of fluid to the annulus 22 when in the collapsed position or during translation to the expanded position. When the moveable arm 1700 is fully expanded, flow path 1860 is aligned with the flow path provided through the drive ring 570, thus allowing flow of fluid from flowbore 1820 through flow path 1860 to nozzle 1875.

Through use of a flowbore provided in the cylindrical tool body itself and location of nozzles on moveable arm 1700, drilling fluid may be emitted through the nozzles at a higher velocity and impinged on the cutting elements 700 at a higher hydraulic energy as compared to use of the flow path described with respect to FIGS. 4 and 5.

Figure 10:
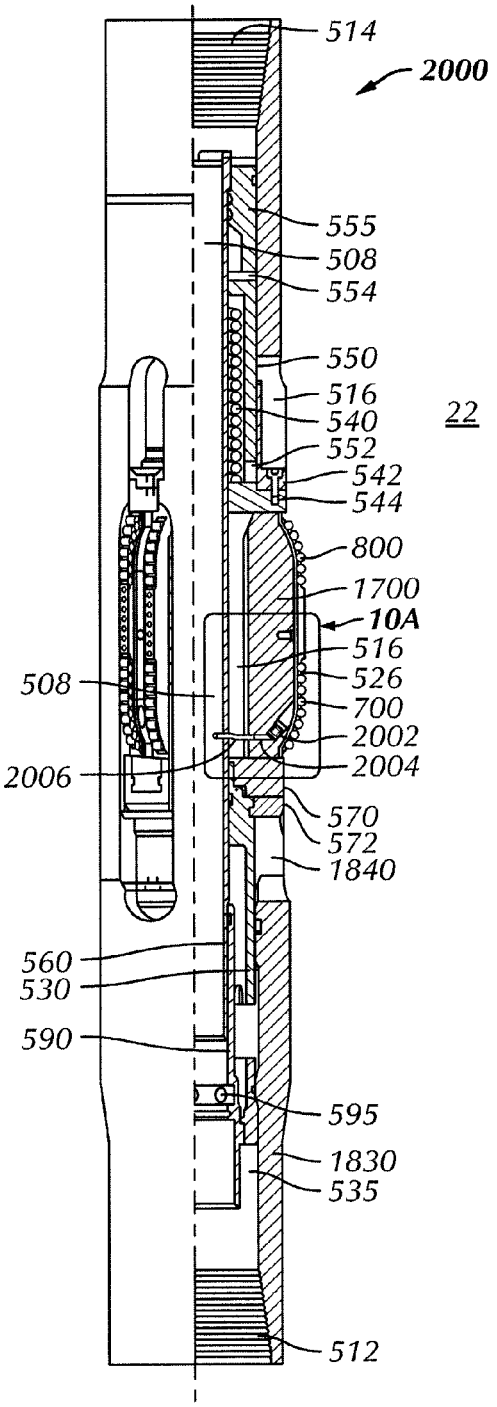
FIGS. 10 and 10A are cross-sectional elevation views of an expandable tool according to embodiments disclosed herein, showing the movable arms in the expanded position.
Figure 10A:
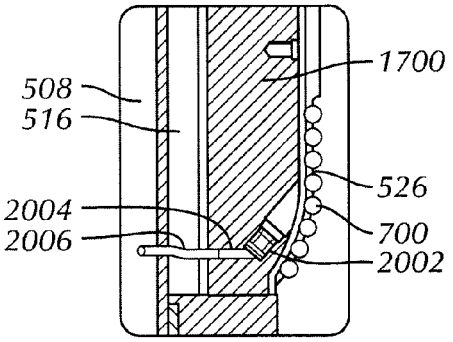

FIGS. 10 and 10A illustrated an alternative embodiment for impinging drilling fluid on the cutting elements at a higher hydraulic energy, where like numerals represent like parts. In this embodiment, expandable tool 2000 includes at least one moveable arm 520 that includes at least one nozzle 2002. Nozzle 2002, located on the arm 520, may be located and used to direct drilling fluid across cutting structures 700, 800 that engage the borehole when the arms 520 are expanded. To deliver the drilling fluid at a higher velocity (i.e., having a lower pressure drop between the inner bore and the nozzle outlet), one or more fluid flow paths 2004 may be provided through the moveable arm 520 to provide fluid communication between the flowbore 508 and nozzles 2002.

In some embodiments, fluid flow paths 2004 may be in direct fluid communication with the fluid in flowbore 508. In other embodiments, such as shown in FIGS. 10 and 10A, a flow conduit 2006 may be provided for transporting fluid from the axial flowbore 508 to the at least one fluid flow path 2004. In some embodiments, flow conduit 2006 may be a flexible flow conduit.

In some embodiments, flow of fluids through one or more of flow conduit(s) 2006, flow path(s) 2004, and nozzle(s) 2002 may be continuous, whether the arm is expanded or not, due to the differential pressure between flowbore 508 and annulus 22.

In other embodiments, flow of fluids through one or more of flow conduit(s) 2006, flow path(s) 2004, and nozzle(s) 2002 may be actuated when the arm is expanded. For example, expandable tool 2000 may include an inner flow control member (not illustrated) having ports therethrough that (a) prevent fluid communication between the axial flowbore 508 and nozzle 2002 when the arm 520 is in a collapsed position, and (b) enable fluid communication between the axial flowbore and nozzle 2002 when the arm 520 is in an expanded or partially expanded position.

Figure 11:
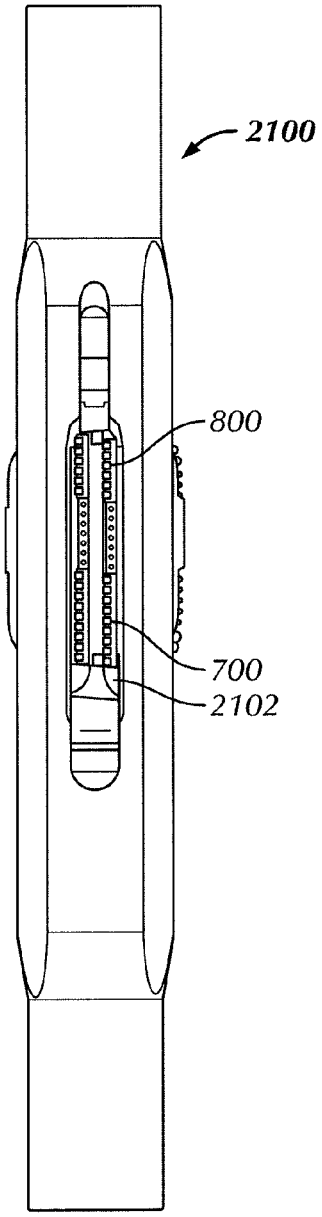
FIGS. 11 and 11A illustrate an expandable tool according to embodiments disclosed herein, showing the movable arms in the expanded position.
Figure 11A:
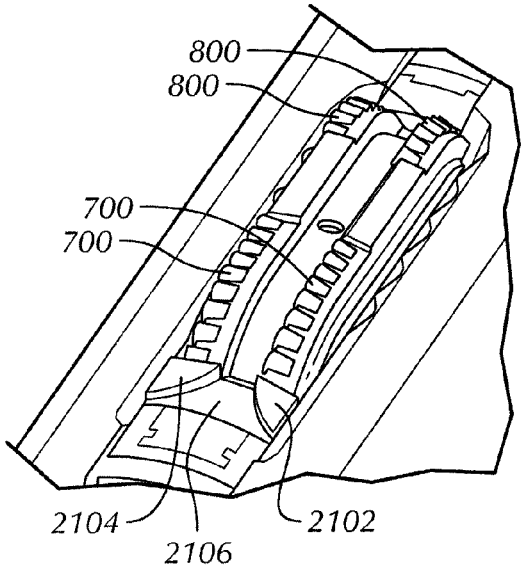
Figure 12:
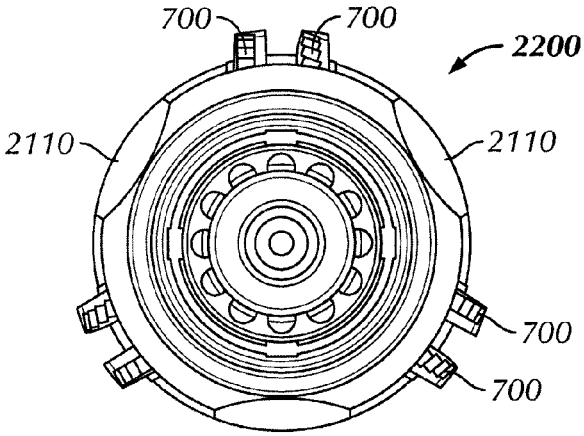
FIGS. 12 and 12A illustrate an expandable tool according to embodiments disclosed herein.
Figure 13:
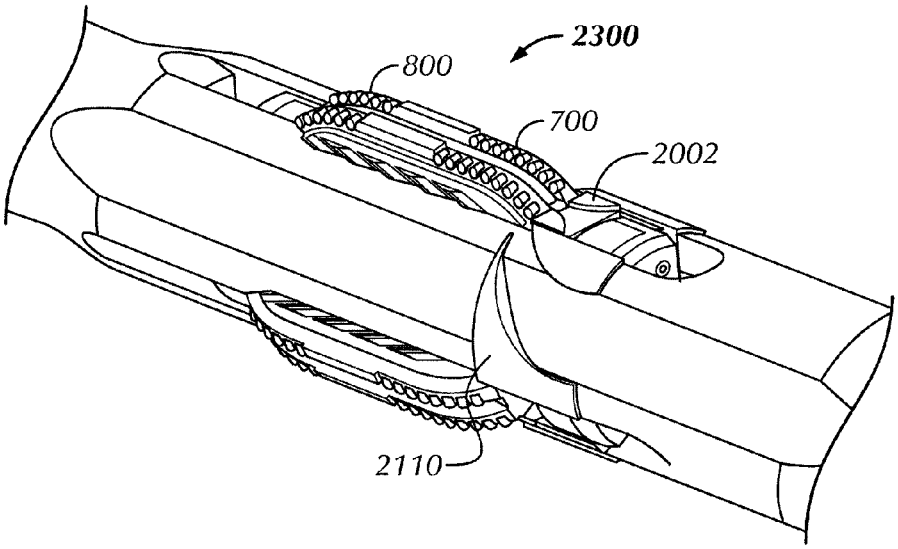
FIG. 13 illustrates an expandable tool according to embodiments disclosed herein.

Referring now to FIGS. 11-13, additional alternative embodiments for impinging drilling fluid on the cutting elements at a higher hydraulic energy are illustrated, where like numerals represent like parts. In the embodiment illustrated in FIGS. 11 and 11A, expandable tool 2100 includes at least one flow directing element 2102, the purpose of which is to decrease the flow area between the annulus formed between the expandable downhole tool 2100 and the wellbore, and to direct the flow of drilling fluid in the annulus toward the cutting structures 700, 800. In this manner, the reduced flow area necessarily results in an increase in annulus fluid velocity, and as the flow is directed toward or over the cutting structures 700, 800, improvements in cooling of the cutting structure and removal of drill cuttings may be realized.

In some embodiments, flow directing elements 2102 may include a raised portion 2104 and a fluid flow path 2106, for example. The raised portion may provide for the decreased annular flow area, and the fluid flow path 2106 may be used to direct the flow directly on to the cutting elements.

Figure 12A:
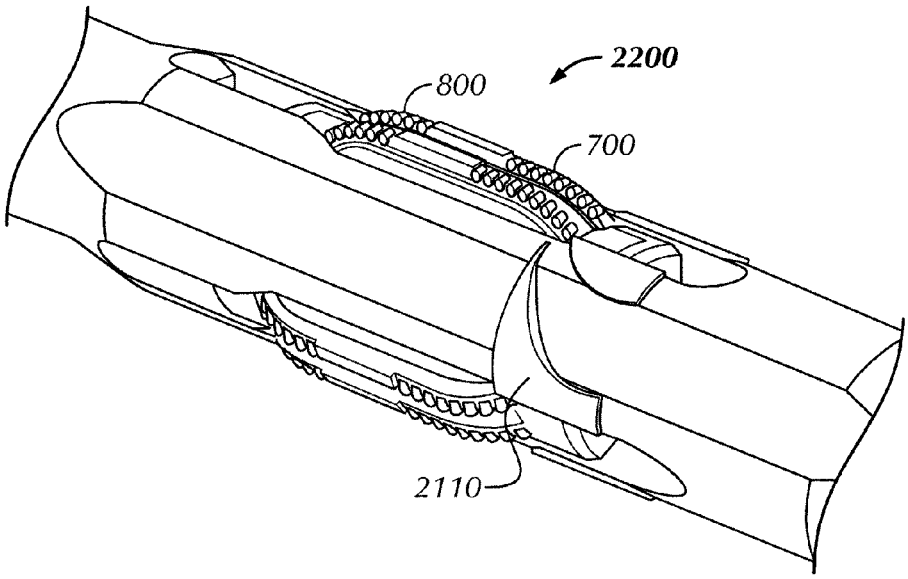

As illustrated in FIGS. 11 and 11A, the arms 520 of expandable tool 2100 include two rows of cutting structures 700, 800, where flow directing elements 2102 are provided to improve flow hydraulics proximate the second row of cutting structures. As illustrated for the expandable tool 2200 in FIGS. 12 and 12A, one or more flow directing elements 2110 may be provided to similarly improve flow hydraulics proximate the first row of cutting structures. FIG. 13 illustrates an expandable tool 2300 including both flow directing elements 2102 and 2110 to improve flow hydraulics proximate both the first and second rows of cutting structures.

The flow directing elements illustrated in FIGS. 11-13 may be used alone or in conjunction with the embodiments as illustrated in any one of FIGS. 4-10.

In operation, an expandable tool (1600, 1800, 2000, 2100, 2200, 2300) is lowered through casing in the collapsed position, such as shown in FIGS. 6 and 8, respectively. The tool may then be expanded automatically when drilling fluid flows through flowbore 508. If more than one tool according to embodiments herein is used, as a stabilizer for example, the second embodiment of the tool would be expanded only after selectively actuating the tool. Whether the feature of selective actuation is present or not, the tools expand due to differential pressure between the flowbore 508 and the wellbore annulus 22 acting on the piston 530. That differential pressure may be in the range of 800 to 1,500 psi. Therefore, differential pressure working across the piston 530 will cause the one or more arms 520 of the tool to move from a collapsed to an expanded position against the force of the biasing spring 540.

Before the drilling assembly is lowered into the borehole, the function of the expandable tools described herein as either an underreamer or as a stabilizer would be determined. Referring again to FIG. 1, one example would be to use either embodiment of the tool (1600, 1800, 2000, 2100, 2200, 2300) in the position of underreamer 120 and in the position of stabilizer 150. As another example, referring to FIGS. 2 and 3, if a winged reamer 220 or a bi-center bit 320 is used instead of an underreamer 120, the tool (1600, 1800, 2000, 2100, 2200, 2300) would preferably be used in the position of stabilizer 150. As an underreamer, embodiments of the expandable tools disclosed herein are capable of underreaming a borehole to a desired diameter. As a stabilizer, embodiments of the expandable tools disclosed herein provide directional control for the assembly 100, 200, 300 within the underreamed borehole 25.

In summary, the various embodiments of the expandable tools disclosed herein may be used as an underreamer to enlarge a borehole below a restriction to a larger diameter. Alternatively, the various embodiments of the expandable tool may be used to stabilize a drilling system in a previously underreamed borehole, or in a borehole that is being underreamed while drilling progresses. Embodiments of the tools disclosed herein may also provide pressure indications at the surface regarding whether the tool is collapsed or expanded.

The various embodiments of the expandable tools disclosed herein have a higher hydraulic capacity than prior art underreamers. An increase in hydraulic energy delivered to the cutting structures may advantageously improve the rate of removal of cuttings from the cutting structures (improved cuttings evacuation), may decrease cutter element wear, and may prevent damage or premature failure. Improved cuttings evacuation may also provide for improved cutting action and increased penetration rates.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. An expandable downhole tool for use in a drilling assembly positioned within a wellbore, comprising:

a tubular body including at least one axial recess, a plurality of channels formed into a wall of said at least one axial recess, and an axial flowbore extending therethrough;

at least one moveable arm, wherein the at least one moveable arm translates along said plurality of channels between a collapsed position and an expanded position in response to a differential pressure between the axial flowbore and the wellbore;

the at least one moveable arm further comprising a borehole-engaging surface;

at least one nozzle to direct a fluid across the borehole-engaging surface of the at least one moveable arm; and at least one flow directing element formed separate from the at least one nozzle and disposed on an outer surface of the tubular body between the at least one nozzle and the at least one moveable arm that:

decreases a flow area in an annulus formed between the expandable downhole tool and the wellbore; and directs a flow of fluid in the annulus toward the borehole-engaging surface.

2. A drilling assembly for underreaming a wellbore to form an enlarged borehole, comprising:

a drill bit to drill the wellbore; and at least one expandable tool as claimed in claim 1.

3. A method of drilling a wellbore, comprising:

using a drill bit to drill the wellbore;

disposing at least one expandable tool as claimed in claim 1 above the drill bit;

using the at least one expandable tool to form an enlarged borehole or to control directional tendencies of said drilling assembly.

4. An expandable downhole tool for use in a drilling assembly positioned within a wellbore, comprising:

a tubular body including at least one axial recess, a plurality of channels formed into a wall of said at least one axial recess, and an axial flowbore extending therethrough;

at least one moveable arm, wherein the at least one moveable arm translates along said plurality of channels between a collapsed position and an expanded position in response to a differential pressure between the axial flowbore and the wellbore;

the at least one moveable arm further comprising a borehole-engaging surface and at least one nozzle to direct a fluid across the borehole-engaging surface of the at least one moveable arm;

at least one fluid flow path extending from an inner surface of the tubular body into a wall of the tubular body and axially upwards through the wall of the tubular body to the at least one nozzle for transporting the fluid from the axial flowbore to the at least one nozzle; and a flow conduit for transporting fluid from the axial flowbore to the at least one fluid flow path.

5. The expandable downhole tool of claim 4, wherein the at least one moveable arm further comprises at least one flow channel in fluid communication with the at least one nozzle and which aligns with the at least one fluid flow path when the at least one moveable arm is in an expanded position.

6. The expandable downhole tool of claim 5, further comprising a piston that translates the at least one moveable arm axially between the collapsed position and the expanded position.

7. The expandable downhole tool of claim 6, further comprising a drive ring and optionally a drive ring retainer connected to the piston and which move with the piston to translate the at least one moveable arm axially between the collapsed position and the expanded position.

8. The expandable downhole tool of claim 7, wherein one or more of the piston, the drive ring, and the drive ring retainer further comprise at least one flow channel for transporting the fluid from the at least one fluid flow path to the nozzle.

9. The expandable downhole tool of claim 8, further comprising a flow conduit disposed within the at least one flow channel of the drive ring and/or the drive ring retainer and movably disposed within the fluid flow path in the tubular body, wherein the flow conduit is configured to move with the drive ring and/or the drive ring retainer during axial translation thereof and to maintain fluid communication between the nozzle and the fluid flow path.

10. The expandable downhole tool of claim 4, further comprising at least one flow directing element that:

decreases a flow area in an annulus formed between the expandable downhole tool and the wellbore; and directs a flow of fluid in the annulus toward the borehole-engaging surface.

11. A drilling assembly for underreaming a wellbore to form an enlarged borehole, comprising:

a drill bit to drill the wellbore; and at least one expandable tool as claimed in claim 4.

12. A method of drilling a wellbore, comprising:

using a drill bit to drill the wellbore;

disposing at least one expandable tool as claimed in claim 4 above the drill bit;

using the at least one expandable tool to form an enlarged borehole or to control directional tendencies of said drilling assembly.

13. An expandable downhole tool for use in a drilling assembly positioned within a wellbore, comprising:

a tubular body including at least one axial recess, a plurality of channels formed into a wall of said at least one axial recess, and an axial flowbore extending therethrough;

at least one moveable arm, wherein the at least one moveable arm translates along said plurality of channels between a collapsed position and an expanded position in response to a differential pressure between the axial flowbore and the wellbore;

at least one nozzle to direct a fluid across a borehole-engaging surface of the at least one moveable arm; and at least one fluid flow path extending from an inner surface of the tubular body into a wall of the tubular body and axially upwards through the wall of the tubular body to the at least one nozzle for transporting the fluid from the axial flowbore to the at least one nozzle.

14. The expandable downhole tool of claim 13, further comprising an inner member with ports therethrough that enable fluid communication between the axial flowbore and the at least one fluid flow path.

15. The expandable downhole tool of claim 13, wherein the at least one moveable arm comprises the at least one nozzle.

16. The expandable downhole tool of claim 15, wherein the at least one moveable arm further comprises at least one flow channel which aligns with the at least one fluid flow path when the at least one moveable arm is in an expanded position.

17. The expandable downhole tool of claim 13, further comprising a piston that translates the at least one moveable arm axially between the collapsed position and the expanded position.

18. The expandable downhole tool of claim 17, further comprising a drive ring and optionally a drive ring retainer connected to the piston and which move with the piston to translate the at least one moveable arm axially between the collapsed position and the expanded position.

19. The expandable downhole tool of claim 18, wherein the at least one nozzle is disposed in at least one of the piston, the drive ring, the drive ring retainer, and the at least one moveable arm.

20. The expandable downhole tool of claim 19, wherein one or more of the at least one moveable arm, the piston, the drive ring, and the drive ring retainer further comprise at least one flow channel for transporting the fluid from the at least one fluid flow path to the nozzle.

21. The expandable downhole tool of claim 20, further comprising a flow conduit disposed within the at least one flow channel of the drive ring and/or the drive ring retainer and movably disposed within the fluid flow path in the tubular body, wherein the flow conduit is configured to move with the drive ring and/or the drive ring retainer during axial translation thereof and to maintain fluid communication between the nozzle and the fluid flow path.

22. The expandable downhole tool of claim 13, further comprising at least one flow directing element that:

decreases a flow area in an annulus formed between the expandable downhole tool and the wellbore; and directs a flow of fluid in the annulus toward the borehole-engaging surface.

23. A drilling assembly for underreaming a wellbore to form an enlarged borehole, comprising:

a drill bit to drill the wellbore; and at least one expandable tool as claimed in claim 13.

24. A method of drilling a wellbore, comprising:

using a drill bit to drill the wellbore;

disposing at least one expandable tool as claimed in claim 13 above the drill bit;

using the at least one expandable tool to form an enlarged borehole or to control directional tendencies of said drilling assembly.

* * * * *